US012276170B2

(12) United States Patent
Beaver et al.

(10) Patent No.: US 12,276,170 B2
(45) Date of Patent: Apr. 15, 2025

(54) SUBSEA WELLHEAD MONITORING SYSTEM

(71) Applicant: HUNTING ENERGY SERVICES, LLC, Houston, TX (US)

(72) Inventors: Brandon Beau Beaver, Spring, TX (US); Jonathan Michael Durham, Richmond, TX (US); Robert E. Smith, III, Missouri City, TX (US)

(73) Assignee: Hunting Energy Services, LLC, Houston, TX (US)

( * ) Notice: Subject to any disclaimer, the term of this patent is extended or adjusted under 35 U.S.C. 154(b) by 0 days.

(21) Appl. No.: 18/229,080

(22) Filed: Aug. 1, 2023

(65) Prior Publication Data

US 2024/0068319 A1 Feb. 29, 2024

Related U.S. Application Data

(60) Provisional application No. 63/402,732, filed on Aug. 31, 2022.

(51) Int. Cl.
*E21B 33/043* (2006.01)
*E21B 33/035* (2006.01)
(Continued)

(52) U.S. Cl.
CPC ..... *E21B 33/043* (2013.01); *E21B 33/0355* (2013.01); *E21B 47/06* (2013.01)

(58) Field of Classification Search
CPC ..... E21B 33/043; E21B 33/0355; E21B 47/06
See application file for complete search history.

(56) References Cited

U.S. PATENT DOCUMENTS 5,107,931 A 4/1992 Valka et al.
5,992,526 A 11/1999 Cunningham et al.
(Continued)

FOREIGN PATENT DOCUMENTS

WO 2012027476 A1 3/2012
WO 2023156770 A1 8/2023

OTHER PUBLICATIONS

Total Marine Technology, "Abandonment Tooling: Temporary Abandonment Cap," Brochure, undated, obtained from tmtrov.com on Jul. 10, 2023, 1-pg.
(Continued)

*Primary Examiner* — Matthew R Buck
*Assistant Examiner* — Douglas S Wood
(74) *Attorney, Agent, or Firm* — Cabello Hall Zinda, PLLC

(57) ABSTRACT

A subsea wellbore monitoring system of the present disclosure includes hanger, plug, and monitoring assemblies. The hanger assembly installs on landing in the wellhead, engages the lock profile, and has a hanger seal sealing in the wellhead. The plug assembly is supported in the hanger assembly and has a plug seal to seal in the landing. Ports of the plug assembly communicate with a bore envelope and an annulus envelope. The monitoring assembly has pressure monitors that communicate with the ports and measure pressure measurements related to the envelopes. The hanger and plug seals can be elastomeric and/or metal elements. The hanger and plug seals are preferably expandable or can be energized outward so the seals can pass any shoulders and profiles when installed in the wellbore and can then seal against the internal surfaces.

25 Claims, 10 Drawing Sheets

(51) Int. Cl.
*E21B 47/00* (2012.01)
*E21B 47/06* (2012.01)

(56) References Cited

U.S. PATENT DOCUMENTS

| | | | | |
|---|---|---|---|---|
| 6,474,416 | B2 | 11/2002 | Beall et al. | |
| 6,615,923 | B1 | 9/2003 | Lay et al. | |
| 6,817,417 | B2 | 11/2004 | Blair et al. | |
| 6,845,815 | B2 | 1/2005 | Hergarden et al. | |
| 7,051,804 | B1 | 5/2006 | Arning | |
| 7,325,598 | B2 | 2/2008 | Bartlett | |
| 7,600,571 | B2 | 10/2009 | Smith | |
| 7,621,340 | B2 | 11/2009 | Cuthill et al. | |
| 7,637,325 | B2 | 12/2009 | Goonetilleke et al. | |
| 8,739,883 | B2 | 6/2014 | Aarnes et al. | |
| 8,813,853 | B1 | 8/2014 | Peterson et al. | |
| 8,997,872 | B1 | 4/2015 | Lugo | |
| 9,534,466 | B2 | 1/2017 | Pathak et al. | |
| 10,947,789 | B1 | 3/2021 | Al-Abdulrahman et al. | |
| 10,989,008 | B2 | 4/2021 | Kaster | |
| 11,220,877 | B2 | 1/2022 | Thomas | |
| 11,624,265 | B1 | 4/2023 | Sehsah et al. | |
| 2003/0127229 | A1 | 7/2003 | Buckle et al. | |
| 2004/0104024 | A1* | 6/2004 | Kent | F16K 3/02 166/368 |
| 2005/0028980 | A1* | 2/2005 | Page | E21B 33/0353 166/373 |
| 2005/0199389 | A1* | 9/2005 | Dallas | E21B 47/117 166/250.07 |
| 2010/0101800 | A1 | 4/2010 | June et al. | |
| 2013/0043034 | A1* | 2/2013 | Drablier | E21B 43/128 307/151 |
| 2017/0183935 | A1* | 6/2017 | Brown | E21B 43/128 |
| 2019/0257171 | A1 | 8/2019 | Ingram et al. | |
| 2020/0018134 | A1 | 1/2020 | Løvoll et al. | |
| 2021/0071519 | A1* | 3/2021 | Gordon | E21B 47/11 |
| 2021/0270104 | A1* | 9/2021 | Løvoll | E21B 33/043 |

OTHER PUBLICATIONS

Trendsetter, "Trident Modular Intervention System," Technical Information Sheet, undated, obtained from trendsetterengineering.com on Jul. 27, 2023, 2-pgs.

Vralstad, T. et al., "Plug & abandonment of offshore wells: Ensuring long-term well integrity and cost-efficiency," Journal of Petroleum Science and Engineering 173, Oct. 17, 2019, pp. 478-491.

International Search Report and Written Opinion in PCT/US2023/030098 mailed Nov. 2, 2023, 9-pgs.

Boon, Willem, et al.; "Successful Deployment of an Innovative Passive Well Monitoring Technology"; undated, obtained from www.spe-aberdeen.org/uploads/1420_S1.PDF; downloaded on Aug. 23, 2024, 19-pgs.

Roscoe, J.; "Successful installation of passive technology for two major projects in Australia"; Offshore & Subsea; downloaded from www.oilfieldtehcnology.com; dated Aug. 22, 2024; 2-pgs.

Sentinel Subsea, "WellSentinal(TM)—passive well integrity monitoring"; undated, downloaded from www.sentinel-subsea.com/WellSentinel on Aug. 23, 2024; 11-pgs.

* cited by examiner

SUBSEA WELLHEAD MONITORING SYSTEM

CROSS-REFERENCE TO RELATED APPLICATIONS

This application claims the benefit of U.S. Provisional Appl. No. 63/402,732 filed Aug. 31, 2022, which is incorporated herein by reference in its entirety.

BACKGROUND OF THE DISCLOSURE

Offshore wells may be abandoned for various reasons to decommission and seal the wells located in offshore environments. This process is carried out to ensure the safety and environmental integrity of the offshore site once the well is no longer productive or economically viable. When abandoning a well, operators are required to adhere to strict regulations set by governmental bodies and industry standards. These regulations ensure that the well is properly plugged and abandoned, and the site is left in a safe and environmentally sound condition.

In the Gulf of Mexico, for example, Bureau of Safety and Environmental Enforcement (BSEE) requires operators to remove all wells and other facilities when those assets are no longer useful and pose a hazard to safety or the environment (BSEE Regulation 250.1703 & 250.1711). BSEE Regulations—NTL 201-0G05 defines "No longer useful for operations" in the regulations for idle wells, such as wells having no production for 5 years and having no plans for future operations. There are 1,010 total idle wells currently in Gulf of Mexico (BSEE, 2022).

The Petroleum Law (Law 9,478/97) is the governing law executed by Petroleum Agency's (ANP) that describes government's policy for energy resources. This law is like US BSEE, where regulation is enacted to ensure the safety of people and the environment during exploration and production of natural resources.

Globally, most operators (UK & USA) are required to secure bonds for each area offshore it has either exploration or development plans to capture hydrocarbons. These bonds are non-refundable until the lease block or offshore segment is returned to prior condition with the current owner of the area. When the current lease owner declares bankruptcy, the previous lease owner is required to take over the responsibility of the lease area, including all costs associated with BSEE Regulation 250.1703 & 250.1711.

Idle wells must be permanently abandoned (P&A) or temporarily abandoned (T&A) within 3 years after being classified as "Idle." In a third option, downhole isolation can be provided in the well by setting downhole plugs, but the well must still be P&A or T&A within 2 years of setting the downhole plugs.

Plug and Abandonment operations involve sealing the wellbore to prevent the migration of fluids and gases. This typically includes setting cement plugs at various intervals and installing mechanical barriers to permanently isolate the reservoir. Once the wellbore is sealed, the wellhead equipment and associated infrastructure is removed. The cost of abandoning offshore wellheads can vary significantly depending on several factors, including the complexity of the well, water depth, wellhead configuration, and local regulatory requirements. Abandonment costs often include expenses related to engineering studies, equipment mobilization, well plugging, wellhead removal, site remediation, and regulatory compliance.

In the Gulf of Mexico, for example, three (3) barriers are required when a well is being temporarily abandoned (T&A). Historically, the three barriers are provided using multiple levels of cement plugs ascending from the well shoe to the top of the wellhead (+/−30 ft below mudline). Re-entering a temporarily abandoned well can be costly. For example, the blowout preventer (BOP) must be installed, and the first cement plug is drilled out. Once the first cement plug is drilled, the mud pits need to be cleaned out and changed to drilling mud, which can be used to perform negative drill out test prior to being able to drill out the second cement plug. The procedures can differ depending on what fluids are left in the well between each plug. Historically, some operators will leave completion fluid and wastewater with the intention of not returning to the well—this is more relevant for legacy wells, such as those that are 10 years old or more.

In some instances, older idle wells do not have three (3) barriers. These earlier wells have been abandoned and may be leaking to some degree. Along with the leaking wells, some production trees are locked on wellheads and cannot be removed. Only some of these idles wells may have good well logs and may be considered safe, but the majority may not.

As can be seen, the costs and requirements associated with abandoning offshore wellheads can be substantial and can vary on a case-by-case basis. The unique characteristics of each well and its location will influence the specific procedures and expenses involved. Therefore, operators are always seeking ways to complete the abandonment process while meeting all regulatory obligations and conserving the costs involved.

In the past, a temporary subsea tree, such as Trendsetter's Trident System (Well Containment System), has been used for well intervention. This temporary subsea tree uses a traditional wellhead connector with a dual zone ram cavity similar to a traditional BOP. Also, a cap has been used on wellheads. For example, Universal Subsea Inc. introduced its Defender Subsea Isolation Cap to install on a wellhead. This cap is not a pressure containing system, but allows preservation fluids to be injected into the top of the wellhead area. The cap locks on the outside dimension of the wellhead assembly with a latching mechanism utilizing short locking pins.

The subject matter of the present disclosure is directed to overcoming, or at least reducing the effects of, one or more of the problems set forth above.

SUMMARY OF THE DISCLOSURE

Some implementations disclosed herein relate to a system for plugging and monitoring a subsea wellhead in a subsea environment. The subsea wellhead has a bore with a landing and a lock profile therein. For example, the disclosed system includes a hanger assembly, a plug assembly, and a monitoring assembly. The hanger assembly is configured to install on the landing and configured to engage the lock profile. The hanger assembly has an annular hanger seal configured to seal in the bore. The plug assembly is supported in the hanger assembly and has an annular plug seal, which is configured to seal in the landing. The plug assembly at least defines first and second ports. The first port is configured to communicate with a bore envelope of the subsea wellhead, which is the area below the annular plug seal that is sealed in the landing. Meanwhile, the second port is configured to communicate with an annulus envelope, which is an area between the annular plug seal (sealed in the landing) and the annular hanger seal (sealed in the bore). The monitoring assembly at least has first and second pressure monitors. The first pressure monitor is configured to communicate with the first port and is configured to measure a first pressure measurement related to the bore envelope. The second pressure monitor is configured to communicate with the second port and is configured to measure a second pressure measurement related to the annulus envelope.

The described implementations may also include one or more of the following features. The hanger assembly may include: a hanger having a landing shoulder and the annular hanger seal, the landing shoulder configured to install on the landing; a locking sleeve installed in the hanger; and a locking ring wedged between the hanger and the locking sleeve and configured to engage the lock profile. The locking sleeve may include a retention ring configured to expand into a retention slot defined in a bowl of the hanger. The disclosed system can have a temporary retainer temporarily retaining the locking sleeve installed in the hanger. The plug assembly may include: a plug portion supported in the hanger, the plug portion having the annular plug seal disposed about a circumference of the plug portion; and a cap portion supported in the hanger above the plug portion and having a third annular seal, the third annular seal configured to seal the plug assembly in the locking sleeve. At least one seal element can be disposed between a connection of the plug portion to the cap portion and can be configured to seal therebetween. The landing shoulder may include a landing ring biased against the hanger, and the landing ring can be configured to engage the landing. The annular hanger seal may include at least one seal element disposed on the hanger assembly between the landing ring and a surface of the hanger assembly. In this way, the at least one seal element can be energized radially outward in response to bias of the landing ring toward the surface of the hanger assembly. The plug assembly may include at least one seal element disposed between the plug assembly and the landing ring and configured to seal therebetween.

In additional implementations, the hanger assembly and the plug assembly can define first and second chambers sealed therebetween. The first and second chambers can define sealed volumes complementary to one another, where an increase in the sealed volume of one of the first and second chambers produces a decrease in the sealed volume of the other of the first and second chamber. The monitoring assembly may include first and second hydraulic connections and first and second control valves. The first hydraulic connection can be controlled by the first control valve and can be configured to communicate with the first chamber. The second hydraulic connection can be controlled by the second control valve and can be configured to communicate with the second chamber. The monitoring assembly may also include a third hydraulic connection and a third control valve. The third hydraulic connection can be controlled by the third control valve and can be configured to communicate with the subsea wellhead.

In further implementations, the hanger assembly may include a landing ring biased on the hanger assembly and configured to engage the landing. The annular hanger seal may include at least one seal element disposed on the hanger assembly between the landing ring and a surface of the hanger assembly. The at least one seal element can be energized radially outward in response to bias of the landing ring toward the surface of the hanger assembly. At least one seal element can be disposed between the plug assembly and the landing ring of the hanger assembly and can be configured to seal therebetween.

In further implementations, the annular plug seal may include at least one first seal element disposed about a first circumference of the plug assembly. The at least one first seal element can have at least one of a first elastomeric seal member and a first metal seal member. The annular hanger seal may include at least one second seal element disposed about a second circumference of the hanger assembly. The at least one second seal element can have at least one of a second elastomeric seal member and a second metal seal member. The annular plug seal can be configured to insert past a shoulder of the landing in the subsea wellhead and can be configured to expand outward to seal with a surface of the landing. The annular hanger seal can be configured to insert past the locking profile in the subsea wellhead and can be configured to expand outward to seal with the bore of the subsea wellhead.

In still further implementations, the plug assembly and the monitoring assembly may include: a first hydraulic connection configured to connect the first port and the first pressure monitor; and a second hydraulic connection configured to connect between the second port and the second pressure monitor. The first pressure monitor may include a first pressure gauge configured to communicate with the bore envelope, and the second pressure monitor may include a second pressure gauge configured to communicate with the annulus envelope. The monitoring assembly may include a third pressure gauge configured to communicate with the subsea environment and configured to measure a third pressure measurement related to hydrostatic pressure of the subsea environment. The monitoring assembly may include an interface in electronic communication with the first and second pressure monitors, where the first and second pressure measurements are readable via the interface. The interface may include one or more of: one or more electronic meters being configured to display the first and second pressure measurements; memory configured to store the first and second pressure measurements and having a data link being electronically readable; and a telemetry system being configured to telemeter the first and second pressure measurements.

Some implementations disclosed herein relate to a method used with a subsea wellhead, which has a bore with a landing and a lock profile therein. In the disclosed method, for example, a plug assembly, supported on a hanger assembly, is passed past the landing in the bore of the subsea wellhead. The hanger assembly installs on the landing in the bore of the subsea wellhead, and the hanger assembly engages in the lock profile of the bore in the subsea wellhead. A first annular seal on the hanger assembly seal against the bore of the subsea wellhead, and a second annular seal on the plug assembly seals in the landing. A first pressure monitor of a monitoring assembly is hydraulically connected in fluid communication via a first port of the plug assembly with a bore envelope of the subsea wellhead below the plug assembly. A second pressure monitor of the monitoring assembly is hydraulically connected in fluid communication via a second port of the plug assembly with an annulus envelope between the plug assembly and the subsea wellhead. Other aspects include corresponding computer systems, apparatus, and computer programs recorded on one or more computer storage devices, each configured to perform the actions of the disclosed methods.

The foregoing summary is not intended to summarize each potential embodiment or every aspect of the present disclosure.

DETAILED DESCRIPTION OF THE DISCLOSURE

Figure 1:
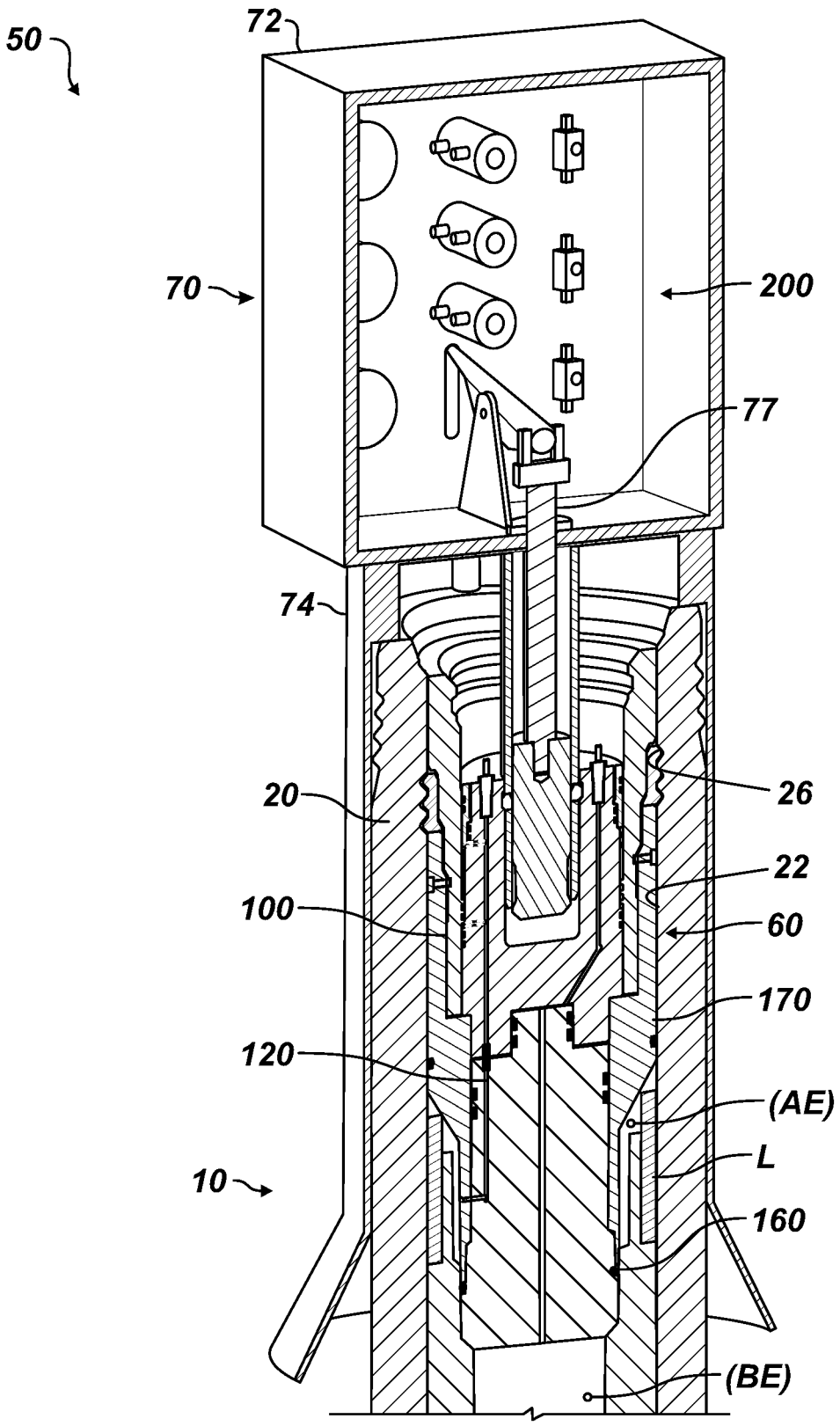
FIG. 1 illustrates a cross-sectional view of a subsea wellhead monitoring system disposed on a subsea wellhead.
Figure 2B:
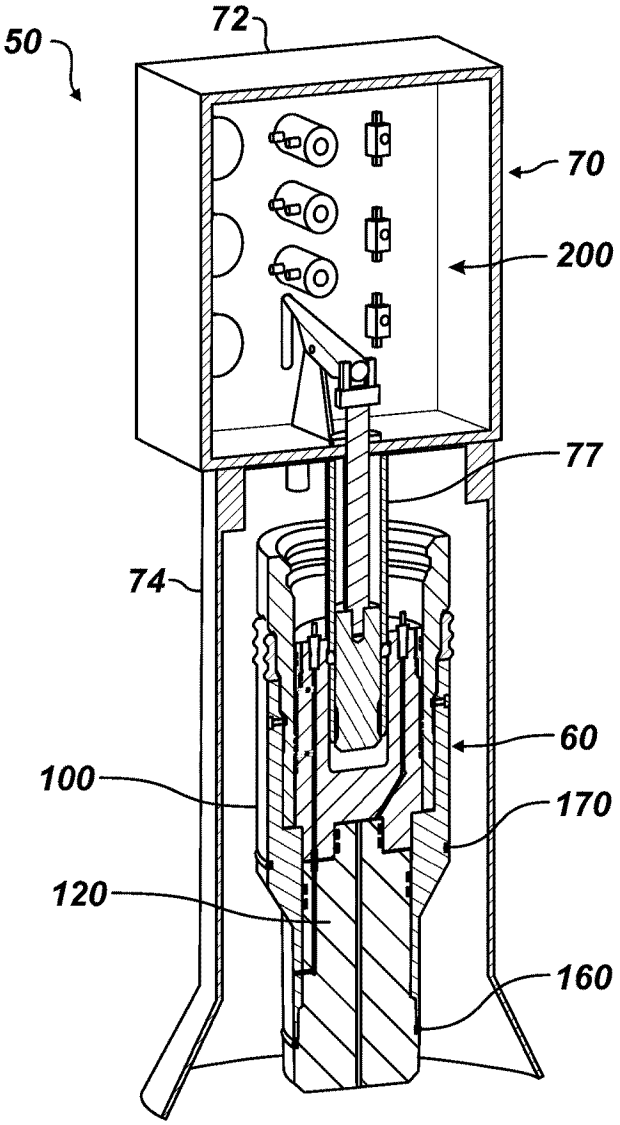
FIG. 2B illustrates a cross-sectional view of the subsea wellhead monitoring.
Figure 2A:
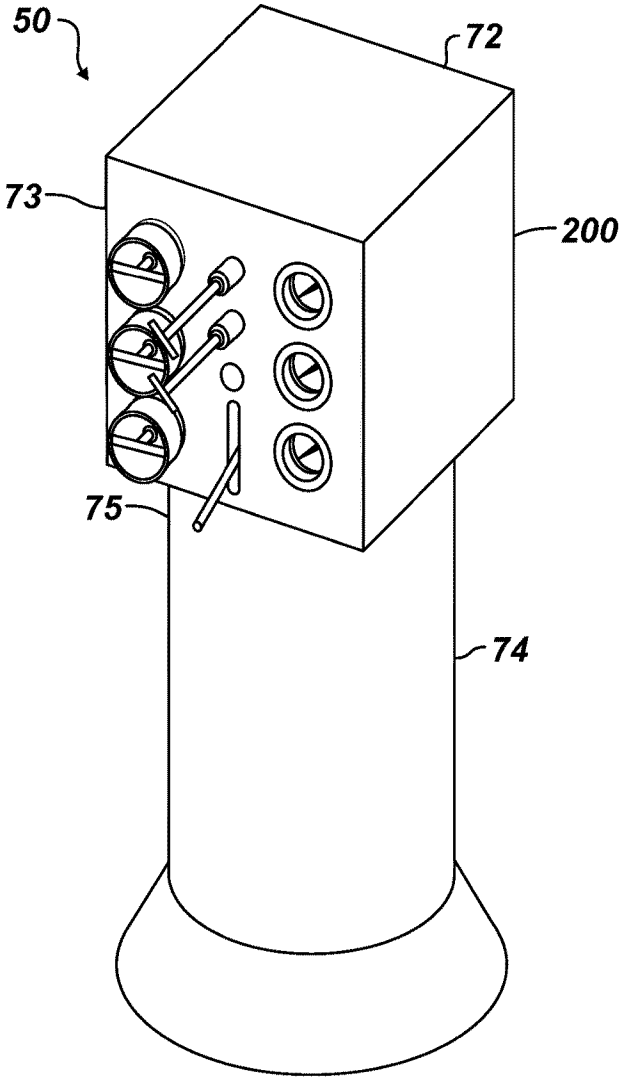
FIG. 2A illustrates a perspective view of the subsea wellhead monitoring system.

FIG. 1 illustrates a cross-sectional view of a subsea wellhead monitoring system 50 disposed on a subsea wellhead 10. The subsea wellhead monitoring system 50 is used for plugging and monitoring the subsea wellhead 10. For further reference, FIG. 2A illustrates a perspective view of the subsea wellhead monitoring system 50, showing a front view of an operation panel 73 on an enclosure 72 for a monitoring assembly 70. FIG. 2B illustrates a cross-sectional view of the subsea wellhead monitoring system 50 without components of the wellhead, showing a sealing assembly 60 and the monitoring assembly 70.

As is typical and shown in FIG. 1, the subsea wellhead 10 includes a wellhead housing 20, which extends from a wellhead conductor (not shown) disposed at the sea floor. The wellhead housing 20 includes a lock profile 26 in the bore 22, and a landing (L) can be disposed in the bore 22. In general, the landing (L) can include a casing hanger, a seal assembly, or the like. Downhole of the subsea wellhead 10, the well can include cement plugs or other barriers (not shown) to seal off the wellbore pressure in the well.

The monitoring system 50 includes a sealing assembly 60 and a monitoring assembly 70. The sealing assembly 60 is configured to install on the landing (L) in the bore 22 of the wellhead housing 20 and is configured to engage the lock profile 26. In particular, the sealing assembly 60 includes a plug assembly 120 supported in a hanger assembly 100. The plug assembly 120 has an annular plug seal 160, which is configured to seal in the landing (L). In turn, the hanger assembly 60 has an annular hanger seal 170, which is configured to seal with the bore 22 of the wellhead housing 20. The annular seals 160, 170 can have at least one of an elastomeric seal member and a metal seal member.

The monitoring assembly 70 mounts on the subsea wellhead 10 and connects to the sealing assembly 60 so the monitoring assembly 70 can monitor pressure in areas or envelopes (BE, AE) of the well.

The sealing assembly 60 can be configured to fit a particular wellhead configuration to perform wellhead locking and sealing. Likewise, the sealing assembly 60 can include interchangeable outer profiles to suit different wellheads, such as those having housings with a typically H-4 profile on the outer diameter.

As shown, the monitoring assembly 70 can include the enclosure 72 disposed on a shroud 74. The enclosure 72 holds various monitoring components 200 including gauges, mechanical controls, interconnects, electronics, and the like. The shroud 74 fits onto the wellhead housing 20 and supports the enclosure 72 atop the wellhead housing 20. As discussed in more detail below, pressure communication lines (not shown) connect from the monitoring components 200 to the plug assembly 120 to perform pressure monitoring of the envelopes (BE, AE) of the well isolated by the annular seals 160, 170. A plunger 77 is connected to a lever 75 on the enclosure 72 and extends from the enclosure 72 to the plug assembly 120. The plunger 77 can engage and disengage with the plug assembly 120 to hold or release the monitoring assembly 70 from the sealing assembly 60.

The subsea wellhead monitoring system 50 provides sealing/locking of the subsea wellhead 10 at the mudline. To do this, the monitoring system 50 is configured to monitor the bore pressure in the bore envelope (BE) of the well and to monitor the annulus pressure in the annulus envelope (AE) above a final seal in the well. For example, the final seal can be a seal provided by a casing hanger for the landing (L) in the wellhead housing 20. The monitoring system 50 can give information about the integrity of the well during temporary abandonment and can prevent leakage to the environment. Should lower cement plugs (not shown) or other barriers downhole in the well begin to leak pressure, the monitoring system 50 detects the leakage operators can plan and perform intervention activities in the well to protect the environment from the wellbore fluids.

Typically, the inner dimension of the wellhead housing 20 is the same for the full length. Conventional pack-off seals used for sealing a casing hanger in the wellhead housing 20 are typically designed to seal in larger diameter grooves or lock profiles in the wellhead bore 22. Therefore, the conventional pack-off seals are expanded into position. The annular seals 160, 170 of the sealing assembly 60 need to pass tapers, perpendicular faces, and anti-rotation slots when the sealing assembly 60 is installed in the wellhead housing 20.

Figure 3:
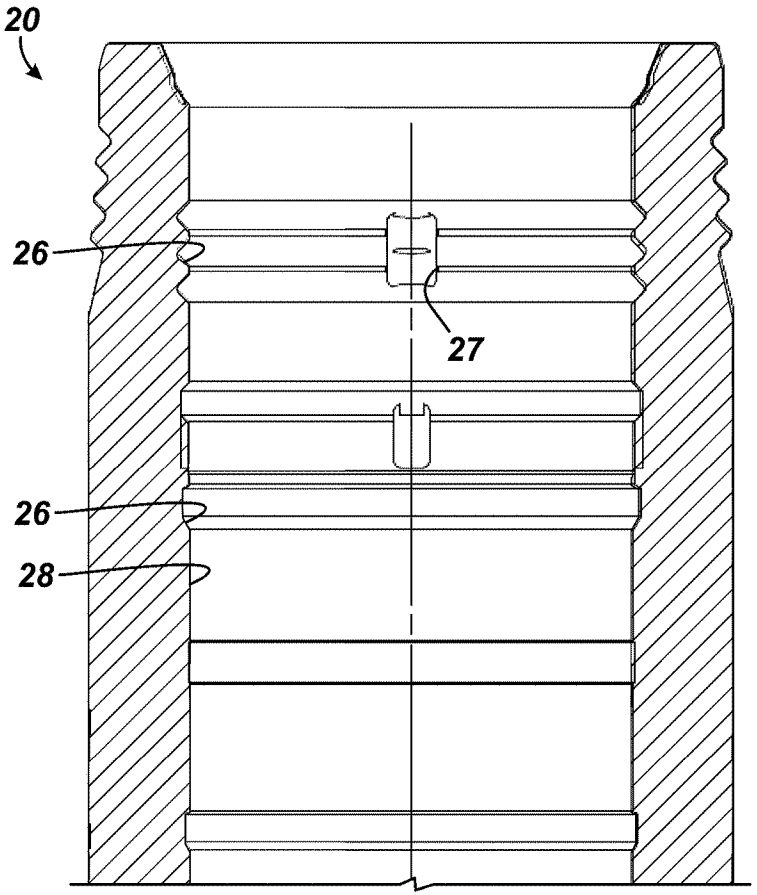
FIG. 3 illustrates a cross-sectional view of an example wellhead housing on which the subsea wellhead monitoring may be installed.

For instance, FIG. 3 illustrates a cross-sectional view of an example wellhead housing 20 in which the disclosed sealing assembly (60) may be installed. The wellhead housing 20 can have various internal grooves and profiles. For example, the lock profile 26 can typically include two or three grooves depending on the type of wellhead. Also, the wellhead housing 20 can have anti-rotation grooves 27, latch profiles 28, and other features. For this reason and as described in more detail below, the sealing assembly 60 can use expanding seal arrangements for the annular seals 160, 170 to avoid engagement with these features during installation.

Figure 4:
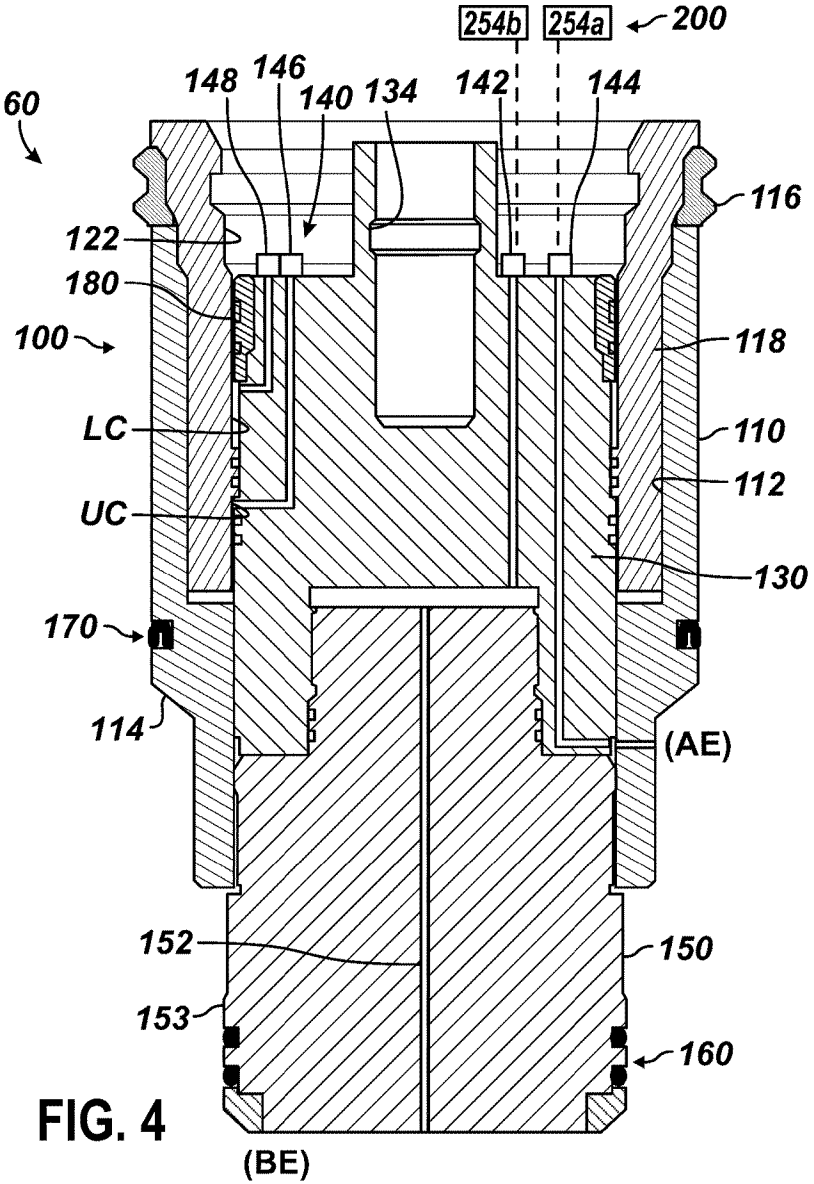
FIG. 4 illustrates a schematic cross-section of a plug assembly of the subsea wellhead monitoring system.

Looking at the monitoring system 50 in further detail, FIG. 4 illustrates a schematic cross-section of a sealing assembly 60 of the subsea wellhead monitoring system 50. Again, the sealing assembly 60 includes a hanger assembly 100 and a plug assembly 120. The hanger assembly 100 includes a hanger 110, a locking ring 116, and a locking sleeve 118. The hanger 110 has a landing shoulder 114 and has an annular hanger seal 170. The landing shoulder 114 is configured to install on the landing (L) in the bore (22) of the wellhead housing (20), and the locking sleeve 118 is configured to install in the bowl 112 of the hanger 110. The locking ring 116 is wedged between the hanger 110 and the locking sleeve 118 and is configured to engage the lock profile (26) of the bore (22) in the wellhead housing (20).

The annular hanger seal 170 comprises a seal element disposed about a circumference of the hanger 110. The seal element can have at least one of an elastomeric seal member and a metal seal member. Because the annular hanger seal 170 is configured to insert past the lock profile (26) and other features in the wellhead housing (20), the annular hanger seal 170 is preferably configured to pass the features and ultimately to expand outward (e.g., radially) to seal with the bore (22) of the wellhead housing (20).

For assembly purposes, the plug assembly 120 includes two portions 130, 150 connected together. These portions 130, 150 can include a cap portion or cap 130 and a plug portion or plug element 150. The plug element 150 is supported in the hanger 110, and the plug element 150 has an annular plug seal 160 disposed about its circumference. The cap 130 is supported in the hanger 110 above the plug element 150 and has an annular cap seal 180. The annular cap seal 180 is configured to seal the cap 130 in the locking sleeve 118. As schematically shown here and discussed in more detail later, the hanger assembly 100 and the plug assembly 120 can include one or more additional seals disposed between the components.

As schematically shown, the plug assembly 120 defines passages or ports 142, 144, 146, 148, 152, etc. for communication with envelopes sealed by the sealing assembly 60 when installed in a subsea wellhead (10). The ports 142, 144, 146, 148 in the cap 130 can have one or more hydraulic connections or couplings 140 to connect the ports 142, 144, 146, 148 to the one or more pressure monitors 254*a-b* and other elements of the monitoring components 200 (and to connect to a running tool during installation).

For example, a bore monitoring port (e.g., 142, 152) is disposed in fluid communication with a bore envelope (BE) of the subsea wellhead (10) below the plug assembly 120. Meanwhile, an annulus monitoring port (e.g., 144) is disposed in fluid communication with an annulus envelope (AE) between the plug assembly 120 when installed in a subsea wellhead (10). Additional ports (146, 148) can connect to other annulus areas or chambers (LC, UC) between the locking sleeve 118 and the hanger 110 as discussed below. These chambers (LC, UC) define commentary sealed volumes, whereby an increase in the sealed volume of one chamber produces a decrease in the sealed volume of the other chamber.

As schematically shown, the monitoring components 200 include one or more pressure monitors 254*a-b*, such as pressure sensors, gauges, or the like to monitor pressure readings in the well's envelopes (BE, AE). Although one pressure monitors 254*a-b* could be used to intermittently monitor pressure readings in the different envelopes provided that appropriate switching features and the like are used, the monitoring components 200 preferably include several pressure monitors 254*a-b*. For example, a first pressure monitor 254*a* is in fluid communication with the bore monitoring ports (142, 152) and is configured to measure a first pressure measurement of the well's bore envelope (BE). Also, a second pressure monitor 254*b* is in communication with an annulus monitoring port (144) and is configured to measure a second pressure measurement of the annulus envelope (AE)

As noted briefly above, the other ports 146, 148 in the cap 130 are disposed in fluid communication with the chambers (LC, UC) between the locking sleeve 118 and the hanger 110. The chambers include a locking chamber (LC) and an unlocking chamber (UC), which can be used in the deployment and retrieval of the sealing assembly 60 from a wellhead housing (20). Additionally, these chambers (LC, UC) can be monitored by one or more additional pressure monitors (not shown) or may share communication with the second pressure monitor 254*b*.

Figure 5A:
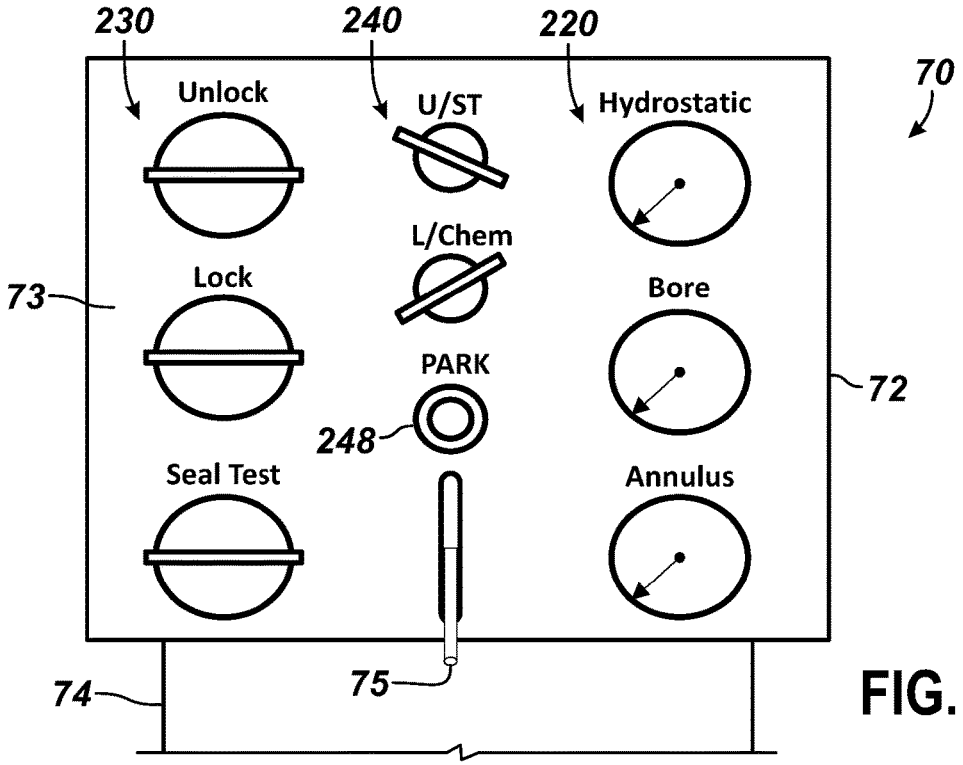
FIG. 5A illustrates a front panel for a monitoring assembly of the present disclosure.
Figure 5B:
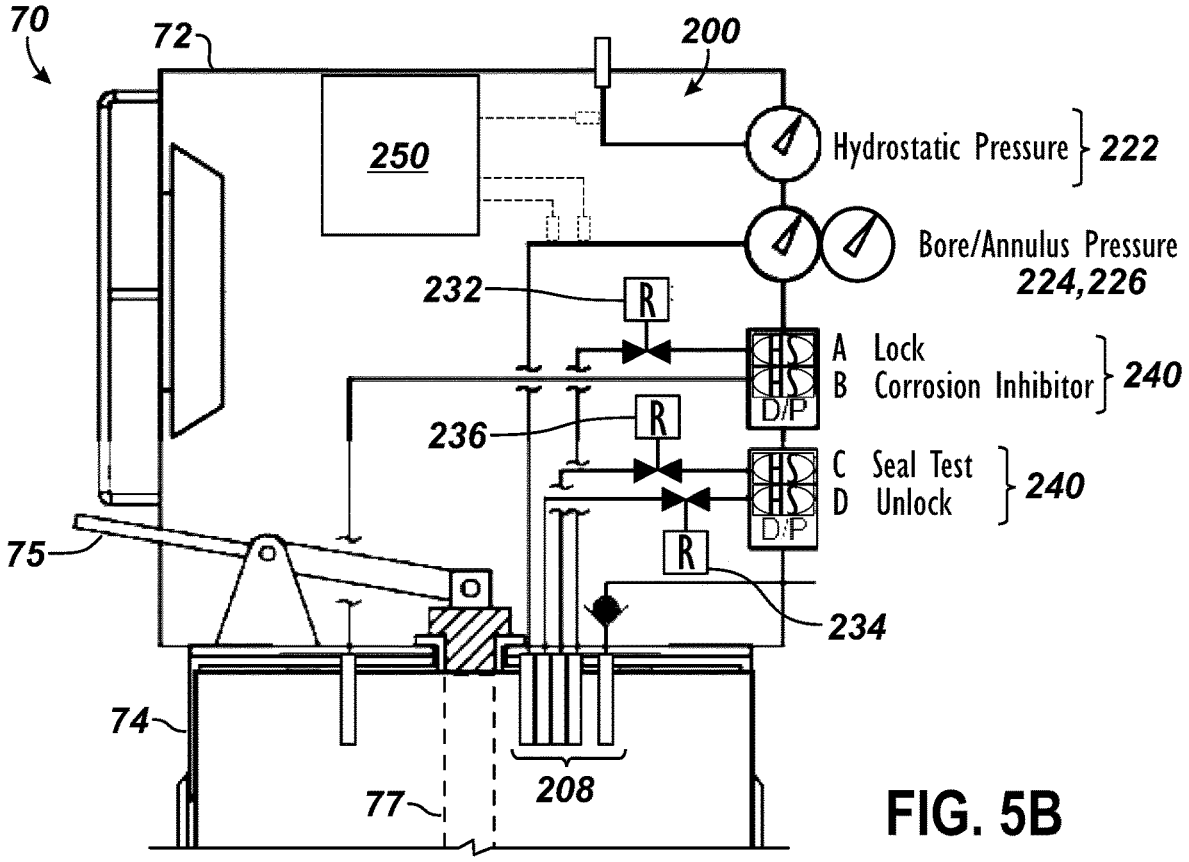
FIG. 5B illustrates a schematic view of components for the monitoring assembly of the present disclosure.

Looking at the monitoring assembly 70, FIG. 5A illustrates a panel 203 for the enclosure 72 of the monitoring assembly 70, and FIG. 5B illustrates a schematic view of the monitoring components 200 for the monitoring assembly 70.

The monitoring assembly 70 can include a number of pressure monitors 220 (e.g., sensors, gauges, etc.), isolation or control valves 230, and hot stabs or hydraulic connections 240. For example, the pressure monitors 220 shown here can include a hydrostatic gauge 222, a bore gauge 224, and an annulus gauge 226. The hydrostatic gauge 222 reads the subsea pressure at the water depth (i.e., hydrostatic pressure), which provides a baseline reading. The bore gauge 224 reads the bore pressure of the wellbore below the plug assembly (120) against the baseline reading. The annulus gauge 226 reads the annulus pressure in the annular area between the sealing assembly (60) and the wellhead (10) against the baseline reading. Although gauges 222, 242, 244 are shown here, the pressure monitors can include, additionally or alternatively, electronic pressure sensors or meters.

The control valves 230 include a lock valve 232, an unlock valve 234, and a seal test valve 236. The hot stabs 240 include a lock hot stab 240A and a chemical injection hot stab 240B (L/Chem on front panel) and include an unlock hot stab 240D and a seal test hot stab 240C (U/ST on front panel). The various hot stabs 240A-D can be arranged as dual port hot stabs or the like. A lever 75 for the mechanical lock or plunger 77 is also included on the monitoring assembly 70 and is used for mechanically locking the monitoring assembly (70) to the sealing assembly (60).

As best shown in FIG. 5B, the lock valve 232 controls communication of the lock hot stab 240A to a connection 208 to the sealing assembly (60), the seal test valve 236 controls communication of the seal test hot stab 240C to a connection 208 to the sealing assembly (60), and the unlock valve 234 controls communication of the unlock hot stab 240D to a connection 208 to the sealing assembly (60). The pressure monitors 220 (e.g., bore and annulus gauges 224, 226) connect by connections 208 to the sealing assembly (60). The chemical injection hot stab 240B can communicate to a connection 208 to the plug assembly (120), which can allow corrosion inhibiting chemicals to be injected into the wellhead (10) and the like. The various connections 208 can include capillary lines, hydraulic lines, hydraulic couplings, and any other necessary components to make the fluid communications.

For its part, the hydrostatic gauge 222 is exposed to an environmental port for measuring the pressure in the subsea environment. A parking connector 248 can be available on the panel 203 for an electrical wet mate connector or the like. Finally, monitoring electronics 250 can be housed in a unit in the monitoring assembly 70 and can include the various electronics, communication interfaces, data storage, sensors, and the like disclosed herein.

Figure 6A:
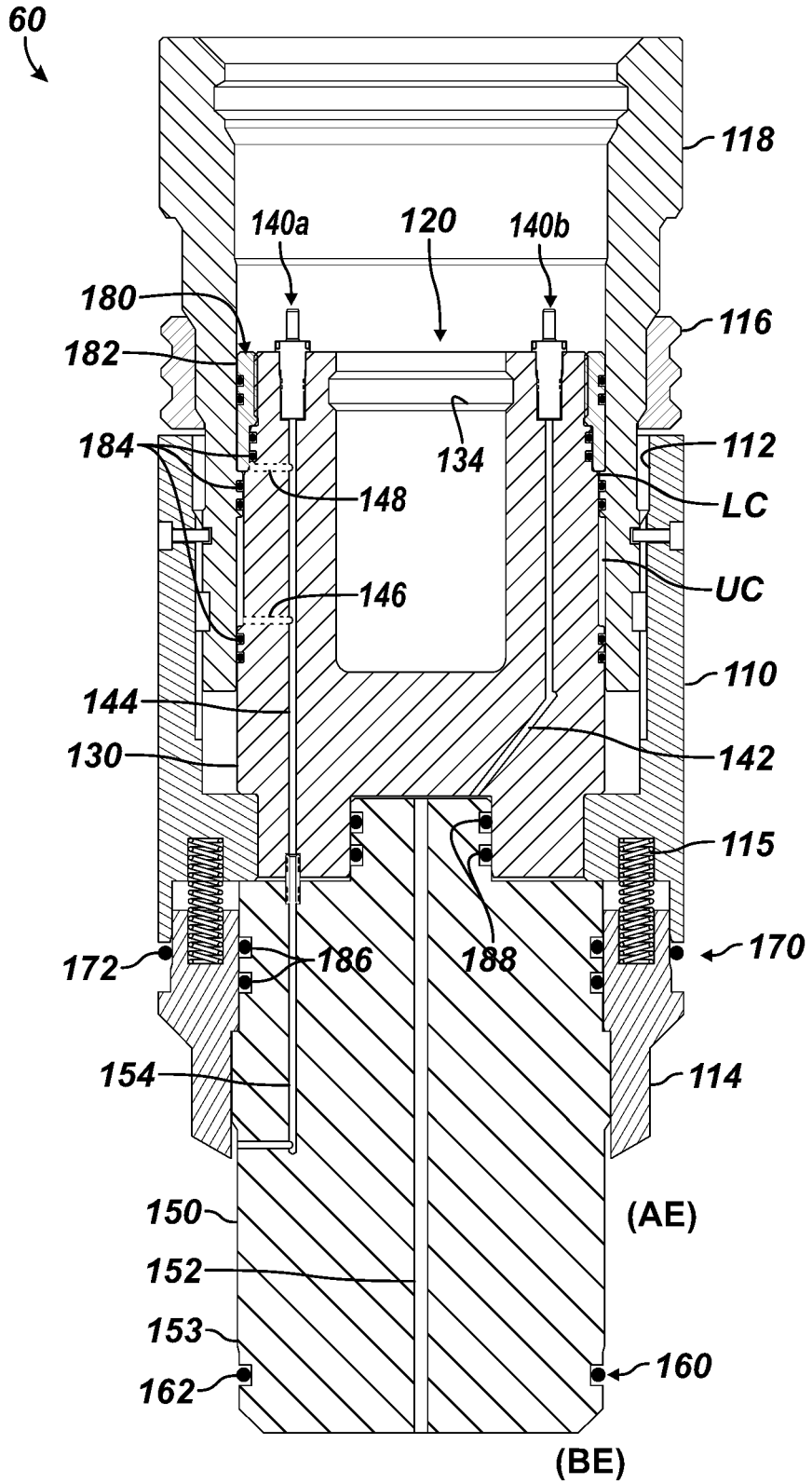
FIG. 6A illustrates a cross-sectional view of a sealing assembly of the present disclosure having a first sealing arrangement.
Figure 6B:
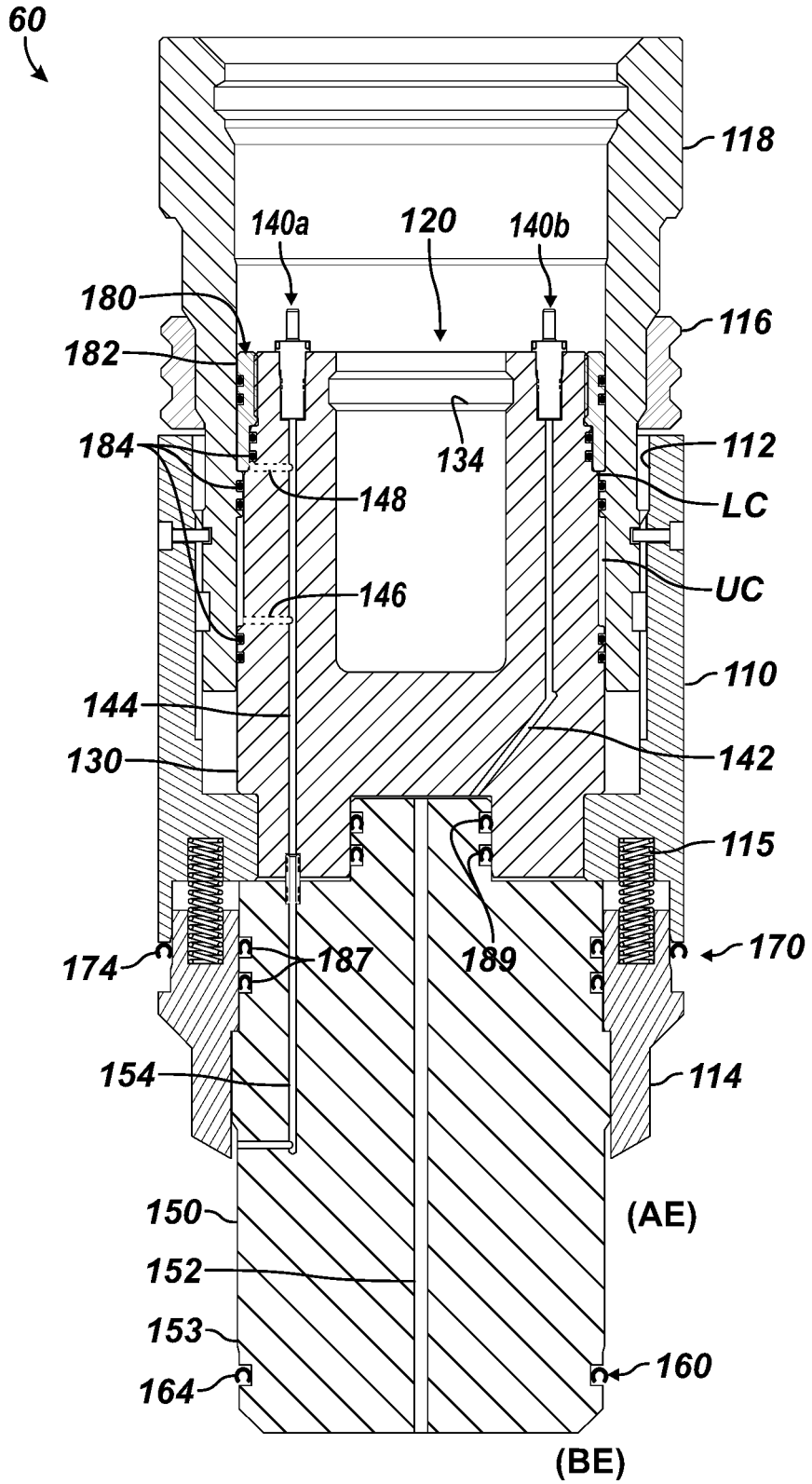
FIG. 6B illustrates a cross-sectional view of the sealing assembly having a second sealing arrangement.

FIGS. 6A-6B illustrate cross-sectional views of a sealing assembly 60 of the present disclosure having different sealing arrangements. Many of the features of the sealing assembly 60 are similar to those discussed previously so similar reference numerals are used.

As before, the sealing assembly 60 includes a hanger assembly 100 and a plug assembly 120. The hanger assembly 120 has a hanger 110, a locking ring 116, and a locking sleeve 118. The hanger 110 has a landing shoulder 114 and an annular hanger seal 170. The plug assembly 120 has a cap 130 and a plug element 150.

The landing shoulder 114 includes a ring biased against the hanger 110. When the sealing assembly 60 is installed in a subsea wellhead (10), the landing ring 114 is configured to engage a landing shoulder on a casing hanger in a bore of the subsea wellhead. The annular hanger seal 170 is disposed between the landing ring 114 and the hanger 110. During installation, the landing ring 114 is biased away from the hanger 110 by springs 115 so that the annular hanger seal 170 is unenergized. This can allow the unenergized annular hanger seal 170 to pass the various shoulders, grooves, and profiles in the bore (22) of the wellhead housing (20). Once the hanger 110 is landed, the landing ring 114 overcomes the bias of the springs 115 and energizes the annular hanger seal 170 to seal with the bore (22).

The locking sleeve 118 is installed in the bowl 112 of the hanger 110 and wedges the locking ring 116 to engage a lock profile (26) of the bore (22) in a wellhead housing (20).

The plug element 150 is supported in the hanger 110, and the plug element 150 has an annular plug seal 160 disposed about its circumference. The cap 130 is supported in the hanger 110 above the plug element 150 and has an annular cap seal 180 to seal in the sealing assembly 60.

For example, the annular cap seal 180 include a pack-off ring 182 configured to seal the cap 130 in the locking sleeve 118. The annular cap seal 180 also includes seals 184 sealing between the cap 130 and the locking sleeve 118. For example, the seals 184 can isolate fluid communication of an unlock port 146 in the cap 130 to an unlock chamber (UC) between the cap 130 and locking sleeve 118. Additionally, the seals 184 can isolate fluid communication of a lock port 148 in the cap 130 to a lock chamber (LC) between the cap 130 and the locking sleeve 118. The unlock and lock ports 146, 148 can be used with a running tool during locking and unlocking of the sealing assembly 60 in the wellhead (10). These ports 146, 148 can also be used for monitoring by pressure monitors after installation.

The annular cap seal 180 also includes seals 186 sealing between the plug element 150 and the landing ring 114 of the hanger 110. Finally, the plug element 150 and the cap 130 can include seals 188 disposed therebetween to isolate communication of the bore monitoring port 142 in the cap 130 to the port 152 in the plug element 150, which communicates with the bore envelope (BE).

In the arrangement of FIG. 6A, the annular plug seal 160 on the plug element 150 includes at least one elastomeric sealing element 162, and the annular hanger seal 170 on the hanger 110 includes at least one elastomeric sealing element 172. These elastomeric sealing elements 162, 172 can be composed of an elastomeric polymer ("elastomer"), an engineering plastic capable of being machined such as polyetheretherketone ("PEEK") or DELRIN® acetal resin, or another suitable material. [E. I. DU PONT DE NEMOURS AND COMPANY, 1007 MARKET ST., WILMINGTON, DELAWARE]. The seals for the pack-off ring 182 and the other seals 184, 186, 188 of the sealing assembly 60 can use similar forms of elastomeric sealing elements.

By contrast, in the arrangement of FIG. 6B, the annular plug seal 160 on the plug element 150 includes at least one metal sealing element 164, and the annular hanger seal 170 on the hanger 110 includes at least one metal sealing element 174. In particular, the annular plug seal 160 can include a pressure-energized metal C-seal 164 to provide a seal between the plug element 150 and a surface in the wellhead (such as the surface of a bowl in a casing hanger in the wellhead). The annular hanger seal 170 can include a pressure-energized metal C-seal 174 to provide a seal between the hanger 110 and another surface in the wellhead (such as the surface of the wellhead housing). The metal C-seal 164, 174 is a ring having first and second sides and having inner and outer dimensions. The first side is convex, and the second side defines an internal cavity. As shown, the second side of the C-seal 164, 174 defining the internal cavity is disposed toward the envelopes in the well (i.e., towards the bore envelope BE and the annular envelope AE from which leaking pressure is to be sealed and monitored). The inner dimension of the C-seal 164, 174 is free to engage external surfaces of the seal assembly (60), and the outer dimension of the C-seal 164, 174 is free to engage internal surfaces or sidewalls of the wellhead (10), each respectively with a sealing force increasing with an increase in the fluid pressure acting in the cavity.

The metal C-seals 164, 174 may be fabricated of a metal alloy, such as INCONEL® alloy 718 [HUNTINGTON ALLOYS CORPORATION, 3200 RIVERSIDE DRIVE, HUNTINGTON, WEST VIRGINIA 25705] or any other suitable material, and the metal C-seals 164, 174 may be plated (e.g., gold plated) to reduce galling.

The pressure-energized metal C-seal 164, 174 is oriented so as to be energized by fluid pressure within the well's envelopes (BE, AE) to provide increased sealing effectiveness. Subject only to space limitations, there may be any number of pressure-energized metal C-seals 164, 174 used for the annular seals 160, 170.

As shown in FIG. 6B, other seals of the seal assembly 60 can also include pressure-energized metal C-seals. For example, metal C-seals 189 can be used between the cap 130 and the plug element 150. Additionally, metal C-seals 187 can be used between the landing ring 114 and the plug element 150. The remaining seals 184 can be elastomeric seals as shown, and the pack-off ring 182 can have elastomeric seals.

Figure 7A:
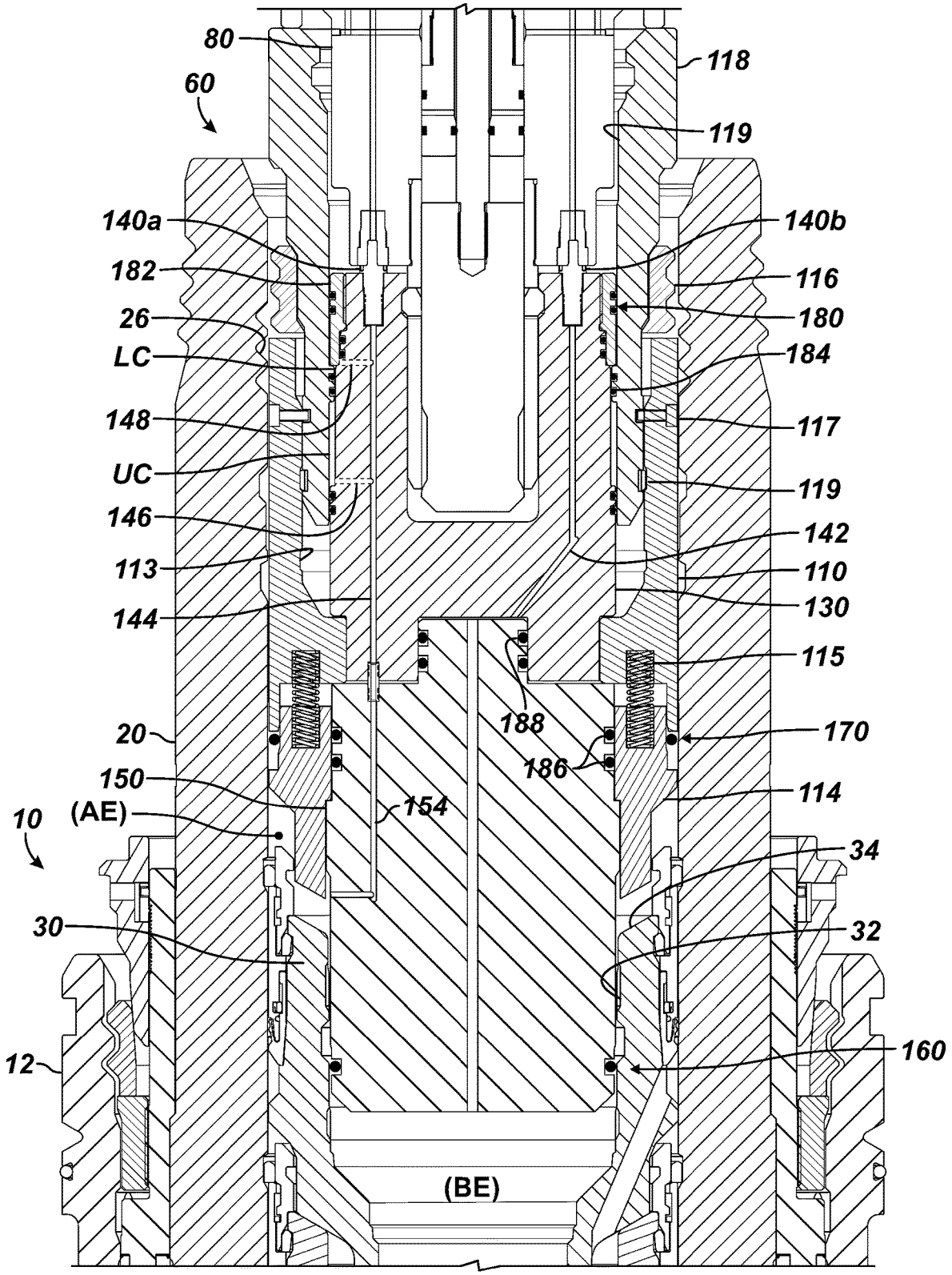
FIG. 7A illustrates a cross-sectional view of a sealing assembly of the subsea wellhead monitoring system being deployed into a subsea wellhead.
Figure 7B:
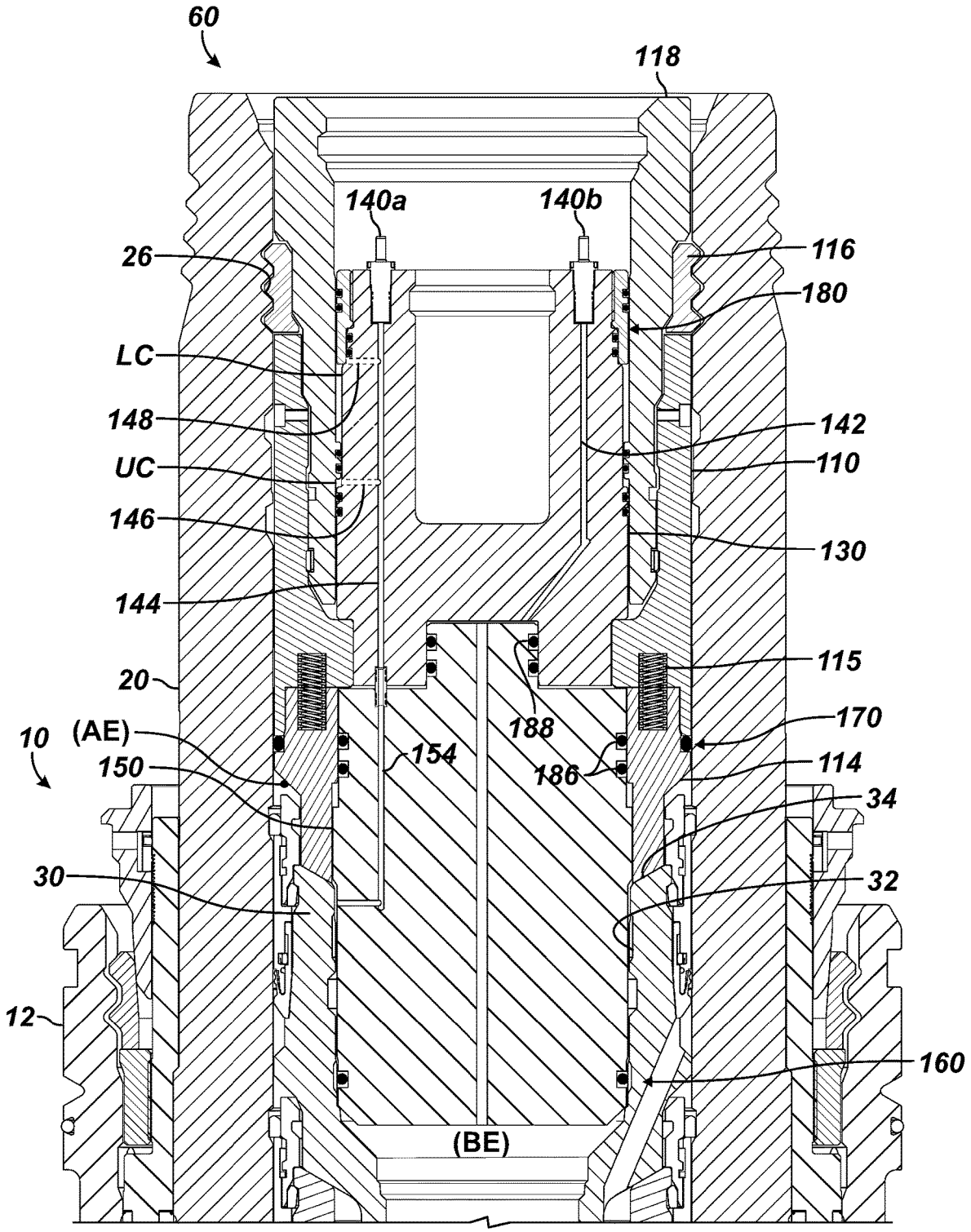
FIG. 7B illustrates a cross-sectional view of the sealing assembly disposed in the subsea wellhead.

FIGS. 7A-7B illustrate cross-sectional views of a sealing assembly 60 of the subsea wellhead monitoring system 50 being installed and landed in a subsea wellhead 10. Many of the features of the sealing assembly 60 are similar to those discussed previously so similar reference numerals are used. In this example, the various seals of the sealing assembly include elastomeric sealing elements. It will be appreciated that installation and landing of the sealing assembly 60 having metal sealing elements would be similarly performed.

As is typical and as shown in FIGS. 7A-7B, the subsea wellhead 10 includes a wellhead housing 20, which extends from a wellhead conductor 12 disposed at the sea floor. The wellhead housing 20 includes the lock profile 26 in the bore 22, and one or more casing hangers 30 can be disposed in the bore 22 to support casing (not shown) below the subsea wellhead 10. The casing hanger 30 has a bowl 32 and a landing shoulder 34.

Again, the sealing assembly 60 includes a hanger assembly 100 and a plug assembly 120. The hanger assembly 100 has a hanger 110, a locking ring 116, and a locking sleeve 118. The hanger 110 has a landing ring 114 and an annular hanger seal 170. The plug assembly 120 has a cap 130 and a plug element 150.

The landing ring 114 is biased relative to the hanger 110 using the springs 115. The landing ring 114 is configured to engage the landing shoulder 34 on the casing hanger 30 in the bore 22 of the subsea wellhead 10. The weight of plug assembly 120 (and the running tool 80) will be greater than spring force of the springs 115 so that the landing ring 114 can be set by the weight.

The annular hanger seal 170 is disposed between the landing ring 114 and the hanger 110. During installation as shown in FIG. 7A, the landing ring 114 is biased away from the hanger 110 by the springs 115 so that the annular hanger seal 170 is unenergized. This can allow the unenergized annular hanger seal 170 to pass the various shoulders, grooves, and profiles in the bore 22 of the wellhead housing 20. Once the hanger 110 is landed as shown in FIG. 7B, the landing ring 114 overcomes the bias of the springs 115 and energizes the annular hanger seal 170 to seal with the bore 22.

The locking sleeve 118 is installed in the bowl 112 of the hanger 110 and wedges the locking ring 116 to engage the lock profile 26 of the bore 22 in the wellhead housing 20. As shown, the locking sleeve 118 includes a retention ring 119 configured to expand into a retention slot 113 defined in the bowl 112 of the hanger 110 to lock the locking sleeve 118 in place.

As before, the plug element 150 is supported in the hanger 110, and the plug element 150 has the annular plug seal 160 disposed about its circumference. The cap 130 is supported in the hanger 110 above the plug element 150 and has an annular cap seal 180 to seal in the sealing assembly 60.

For example, the annular cap seal 180 include a pack-off ring 182 configured to seal in the locking sleeve 118. The annular cap seal 180 also includes seals 184 sealing between the cap 130 and the locking sleeve 118. For example, the seals 184 isolate fluid communication of the unlock port 146 to the unlock chamber (UC) between the cap 130 and locking sleeve 118, and the seals 184 isolate fluid communication of the lock port 148 in the cap 130 to the lock chamber (LC) between the cap 130 and locking sleeve 118. The unlock and lock ports 146, 148 can be used with the running tool 80 during locking and unlocking of the sealing assembly 60 in the subsea wellhead 10. These ports 146, 148 can also be used for monitoring by pressure monitors after installation.

The annular cap seal 180 also includes seals 186 sealing between the plug element 150 and the landing ring 114 of the hanger 110. Because the landing ring 114 is movably biased on the hanger 110 relative to the plug element 150, the additional seals 186 can be provided on the outer circumference of the plug element 150 to seal with the landing ring 114.

Finally, the plug element 150 and the cap 130 can include additional seals 188 disposed therebetween to isolate communication of the bore monitoring port 142 in the cap 130 to the port 152 in the plug element 150, which communicates with the bore envelope (BE).

The annular plug seal 160 on the plug element 150 seals inside the bowl 32 of the casing hanger 30. During installation as shown in FIG. 7A, the annular plug seal 160 passes the landing shoulder 34 and any internal grooves or profiles in the bowl 32 of the casing hanger 30. Therefore, the annular plug seal 160 as noted is preferably expandable, being configured to insert past the landing shoulder 34 of the casing hanger 30 in the subsea wellhead 10 and being configured to expand outward to seal with the bowl 32 of the casing hanger 30. Once installed, the annular plug seal 160 isolates the bore envelope (BE) in the wellhead below the sealing assembly.

The annular hanger seal 170 on the hanger 110 seals inside the bore 22 of the wellhead housing 20. During installation as shown in FIG. 7A, the annular hanger seal 170 passes the lock profiles 26 and any internal grooves or profiles in the wellhead housing 20. Therefore, the annular hanger seal 170 as noted is preferably expandable, being configured to insert past the shoulders and profiles in the wellhead housing 20 and being configured to expand outward to seal with the bore 22. Once installed, the annular hanger seal 170 isolates the annulus envelope (AE) in the wellhead.

The annular plug seal 160 isolates the bore monitoring port 152 in the plug element 150, which communicates with the bore monitoring port 142 in the cap 130. The annular seals 160, 170 isolate the annulus envelope port 154 in the plug element 150, which communicates with the annulus monitoring port 144 in the cap 130.

As noted, the monitoring assembly (70) has at least two pressure monitors (254*a-b*) for monitoring the bore envelope (BE) and the annulus envelope (AE). Therefore, the cap 130 includes at least two coupling members 140*a-b* installed thereon and communicating with the monitoring ports 142 and 144. The coupling members 140*a-b* can be a male coupling member for insertion into a female coupling member of a hydraulic coupling, such as disclosed in U.S. Pat. No. 10,400,541, which is incorporated herein by reference in its entirety. These members 140*a-b* of the hydraulic couplings can be self-sealing and can provide a pressure tight barrier without a running tool or monitoring assembly 70 installed on the sealing assembly 60. A female member is available on the running tool used to run the sealing assembly 60 into the wellhead housing 20, and a female member is available on the monitoring assembly 70 when installed on the wellhead 10 above the sealing assembly 60.

Figure 8:
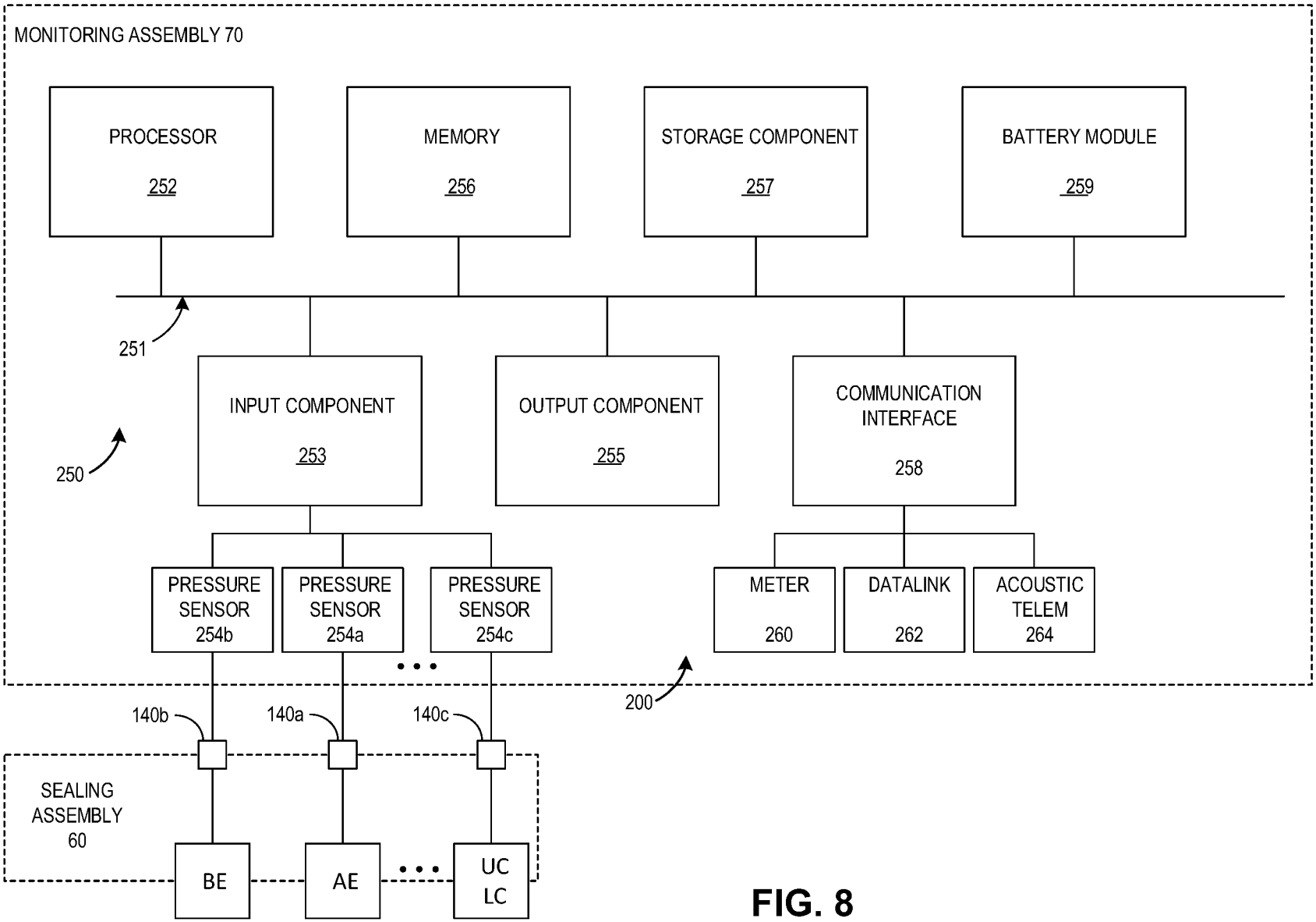
FIG. 8 illustrates a schematic view of a monitoring assembly for the subsea wellhead monitoring system.

FIG. 8 illustrates a schematic view of a monitoring assembly 70 according to an example of the present disclosure for the subsea wellhead monitoring system (50). The monitoring assembly 70 includes the monitoring components 200 and the monitoring electronics 250 that interface with the sealing assembly 60 (having the hanger and plug assemblies 100, 120 as noted above). The monitoring electronics 250 include a bus 251, a processor 252, a memory 256, a storage component 257, an input component 253, an output component 255, a communication interface 258, and a power or battery module 259.

The bus 521 permits communication among the components of the monitoring assembly 70. The processor 252 is implemented in hardware, firmware, or a combination of hardware and software. The processor 252 can include a central processing unit (CPU), a microprocessor, a microcontroller, a digital signal processor (DSP), a field-programmable gate array (FPGA), an application-specific integrated circuit (ASIC), or another type of processing component. In some examples, the processor 252 includes one or more processors capable of being programmed to perform a function. The memory 256 may include one or more storage devices, such as a random-access memory (RAM), a read only memory (ROM), and/or another type of dynamic or static storage device (e.g., a flash memory, a magnetic memory, and/or an optical memory) that stores information and/or instructions for use by processor 252. The storage component 257 stores information, data, pressure measurements, and/or software related to the operation and use of the monitoring assembly 70.

The input component 253 includes an input that permits the monitoring assembly 70 to receive information. Additionally, or alternatively, the input component 253 may include a sensor for sensing information (e.g., sensing pressure readings). The output component 255 includes an output that provides output information from the monitoring assembly 70 (e.g., outputting pressure readings, temperature readings, monitoring status, etc.).

The communication interface 258 includes a transceiver-like component (e.g., a transceiver and/or a separate receiver and transmitter) that enables the monitoring assembly 70 to communicate with other devices, such as via a wired connection, a wireless connection, an acoustic connection, or a combination of such connections. The communication interface 258 may permit the monitoring assembly 70 to receive information from another device and/or provide information to another device. For example, the communication interface 258 may include any suitable interface, such as optical, electrical, or acoustic interface.

The battery module 259 is connected along the bus 251 to supply power to the processor 252, the memory 256, and the internal components of monitoring assembly 70. The battery module 259 may supply power during field measurements by the monitoring assembly 70.

The monitoring assembly 70 may perform one or more processes described herein. The monitoring assembly 70 may perform these processes by the processor 252 executing software instructions stored by a non-transitory computer-readable medium, such as the memory 256 and/or the storage component 257. A computer-readable medium is defined herein as a non-transitory memory device. A memory device includes memory space within a single physical storage device or memory space spread across multiple physical storage devices.

Software instructions may be read into the memory 256 and/or the storage component 257 from another computer-readable medium or from another device via the communication interface 258. When executed, software instructions stored in the memory 256 and/or the storage component 257 may instruct the processor 252 to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

Monitoring of the bore envelope (BE) can be shared between one or more pressure monitors 254*b*. Likewise, monitoring of the annulus envelope (AE) can be shared between one or more pressure monitors 254*a*. Because there are additional areas that can be monitored (e.g., chambers LC, UC), additional pressure monitors 254*c* can be connected to the chambers (LC, UC).

The number and arrangement of components shown in FIG. 8 are provided as an example. In practice, the monitoring assembly 70 may include additional components, fewer components, different components, or differently arranged components than those shown in FIG. 8. Additionally, or alternatively, a set of components (e.g., one or more components) of the monitoring assembly 70 may perform one or more functions described as being performed by another set of components of the monitoring assembly 70.

Information, data, pressure measurements, etc. are available from the communication interface 258. For example, the first and second pressure measurements can be readable via the communication interface 258. To do this, the communication interface 258 can include one or more of: one or more gauges or electronic meters 260 being configured to visibly display the first and second measurement; a data link 262 being electronically readable; and a telemetry system 264 configured to telemeter information, such as the first and second pressure measurements.

As noted above, the hanger and plug assemblies 100, 120 can be installed in the subsea wellhead 10 using a running tool 80. For example, FIG. 9A illustrates a cross-sectional view of a running tool 80 for installing the sealing assembly 60 in a subsea wellhead 10 using drill pipe. The running tool 80 includes a mandrel 81, an outer body 82, and an outer sleeve 88. The mandrel 81 has a piston 83 moveable relative to a stinger 86 on the outer body 82. Movement of the piston 83 shifts a head 85 relative to the stinger 86 and extends or retracts locking dogs 87 that engage in a profile (134) of the cap (130). In general, the ports 89 in the outer body 82 include annulus monitoring port, a bore monitoring port, a lock port, an unlock port, a tool unlock port, and vents. Female hydraulic couplings 84*a-b* are provided for the ports 89 (the lock port, the unlock port, bore monitoring port, and annulus monitoring port) on the outer body 82. These female hydraulic couplings 84*a-b* are configured to connect to comparable male hydraulic couplings (140*a-b*) for corresponding ports on the cap (130) of the plug assembly (120).

Figure 9B:
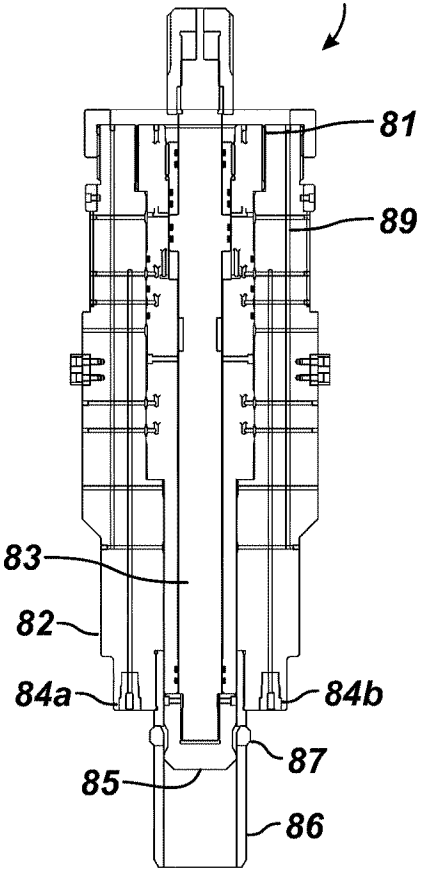
FIG. 9B illustrates a cross-sectional view of another running tool for installing a sealing assembly in the subsea wellhead.
Figure 9A:
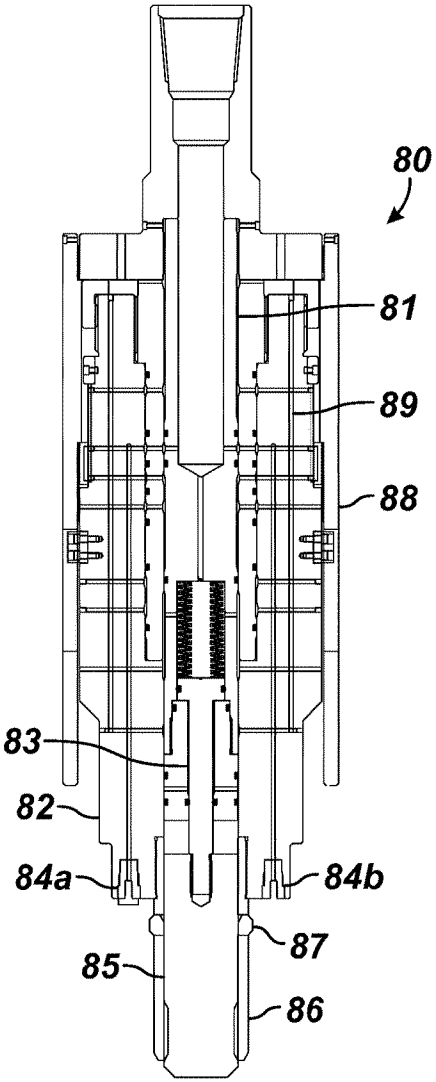
FIG. 9A illustrates a cross-sectional view of a running tool for installing a sealing assembly in the subsea wellhead.

In another arrangement, FIG. 9B illustrates a cross-sectional view of the running tool 80 for installing the sealing assembly 60 in a subsea wellhead using a remotely operated vehicle (ROV). This running tool 80 is similar to the previous tool.

Figure 10A:
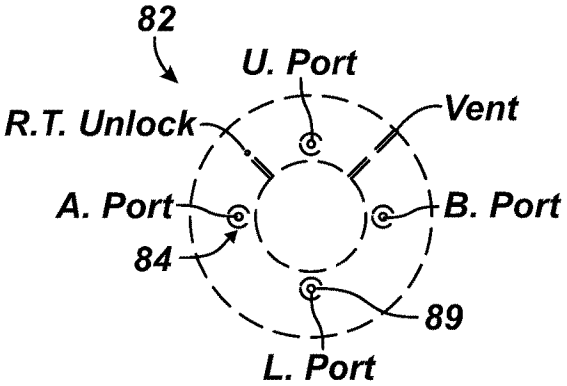
FIG. 10A illustrates a schematic end-section through the plug assembly, showing the arrangement of ports.

FIG. 10A illustrates a schematic end-section through the plug assembly 120, showing the arrangement of the ports 142, 144, 146, 148 from a top-down view. The annulus monitoring port 142, the bore monitoring port 144, the lock port 146, and the unlock port 148—each of which has a coupling 140—are disposed about the circumference of the plug assembly 120.

Figure 10B:
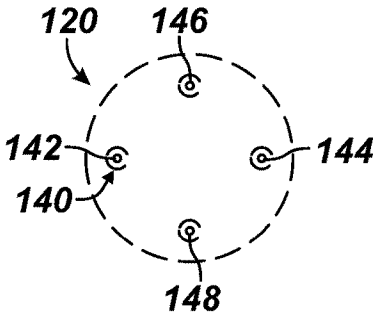
FIG. 10B illustrates a schematic end-section through the running tool's body, showing the arrangement of ports.

FIG. 10B illustrates a schematic end-section through the running tool's body 82, showing the arrangement of ports 89 from a top-down view. The annulus port, the bore port, the lock port, and the unlock port—each of which has a coupling 84—are disposed about the circumference of the body 82. A plurality of vent ports are provided to vent outside the body 82, and a running tool unlock port is provided to communicate with the body 82.

Having an understanding of the disclosed monitoring system 50 and the running tool 80, a method of installing the disclosed monitoring system 50 with the running tool 80 is now discussed with reference to the various figures. The running tool 80 can be operated using manipulations performed by drill pipe or ROV. The following sequence details an example setting sequence and hydraulic requirements to set the sealing assembly 60 into the subsea wellhead 10 and to perform a test using a running tool 80 on a drill pipe.

The running tool 80 is first connected to the sealing assembly 60 supported on deck. The setting tool 80 is lowered into the assemblies until the hydraulic couplings 84*a-b*, 140*a-b* engage. Alignment pins can be used to align the running tool 80 with the sealing assembly 60 to allow correct makeup of the couplings 84*a-b*, 140*a-b*. Spacing would only allow makeup in one orientation, and height would prevent the couplings from contact before correct alignment is achieved.

The mandrel 81 is rotated a set number of turns to lower the mandrel 81 and outer sleeve 88 of the setting tool 80 until the sleeve 88 lands on the sealing assembly 60. The inner head 85 moves down to squeeze the locking dogs 87 into locked position in the cap's profile 134.

The sealing assembly 60 is then run with the running tool (80) to the subsea wellhead 10. For example, the sealing assembly 60 can be run through the BOP or in open water using drill pipe. No umbilical is necessary. If a riser is connected to the BOP, the running tool 80 can run the sealing assembly 60 through the riser.

The running tool 80 runs the sealing assembly 60 into wellhead. At land off, the plug element 150 is moved past the casing hanger 30 in the bore 22 of the subsea wellhead 10, and the hanger 110 is moved past contours, grooves, and profiles in the bore 22 of the wellhead housing 20.

The sealing assembly 60 is landed on the casing hanger 30 in the bore 22 of the subsea wellhead 10. The annular hanger seal 170 on the sealing assembly 60 seals against the bore 22 of the wellhead housing 20, and the annular plug seal 160 on the sealing assembly 60 seals against the casing hanger 30. As noted, the expanding seal design allows the annular seals 160, 170 to be installed past features that could cause damage.

At land off, the bore envelope (BE) and the annulus envelope (AE) are vented through the ports 89 of the running tool 80 above the sealing assembly 60. Both of these envelopes (BE, AE) need to be vented during land off/seal engagement to prevent hydraulic lock. Fluid from the ports in the sealing assembly 60 are communicated through the coupling members 140*a-b*/84*a-b* and into the running tool 80, which then routes this fluid through the ports 89 for venting.

Weight down is then applied to compress the seal expander of the landing ring 114 and springs 115 on the hanger 110. Weight down is applied to compress springs 115 on the landing ring 114, forcing the annular hanger seal 170 out to a larger diameter, sealing in wellhead bore 22. The set down weight compresses the springs 115 and expands the annular hanger seal 170 into the bore 22. The bore and annulus monitoring ports of the sealing assembly 60 are vented from vent ports 89 of the setting tool 80.

Weight down is then applied to lock the sealing assembly 60 in the wellhead housing 20. The lock and unlock ports 146, 148 on the sealing assembly 60 are linked to prevent hydraulic lock so fluid is allowed travel from one annular chamber (UC) to the other annular chamber (LC). Shear screws or other temporary retainer 117 between the locking sleeve 118 and the hanger 110 are sheared. During actuation, the lock ring 116 on the hanger assembly 100 is wedged to engage in the lock profile 26 of the bore 22 in the subsea wellhead 10. The lock ring 119 on the locking sleeve 118 moves into a locking position in a lock groove or retention slot 113 of the hanger 110 to provide resistance to the locking sleeve 118 moving back up. The setting tool 80 is pulled by overpulling up on drill pipe to confirm that the sealing assembly 60 is set correctly.

Weight down is then applied so an annulus pressure test can be performed. As weight is set down again, for example, the ports 89 on the setting tool 80 are now aligned to carry out the annulus pressure test. The unlock port 146 is vented. Drill pipe pressure is routed to the annulus cavity between casing hanger 110 and the wellhead bore 22 to pressure test the plugging by the sealing assembly 60. The bore envelope (BE) below the casing hanger 30 is vented. The void above the piston 83 in the running tool 80 is vented, and the unlock port 144 is blocked so the piston 83 is hydraulically locked.

The volume of the bore envelope (BE) below the plug assembly 120 can be very large and unsuitable for pressure testing. Therefore, the pressure test is performed on the annular envelope (AE) between the annular seals 160, 170. The annulus pressure test is performed between the wellhead's bore 22 and casing hanger's bore or bowl 32 by applying pressure to the annular envelope (AE) to test both annular seals 160, 170. The pressure in the drill pipe is increased to build pressure in the annular envelope (AE) up to a test threshold (e.g., 15,000 psi). If the test is successful, the running tool 80 is then disconnected from the sealing assembly 60. If the pressure test fails, the venting and pressurizing can be repeated.

The running tool 80 on the drill pipe can then be disconnected from the sealing assembly 60. To disconnect, operators pull up on the drill pipe until the setting tool 80 reaches full travel. Ports 89 now align to apply pressure to the piston 83, which can be biased by a predefined spring force. A final unlock pressure is applied to move the piston 83 so the locking dogs 87 disengage from the cap profile 134.

Once the running tool 80 is removed, the monitoring assembly 70 can be installed on the subsea wellhead 10. The connections 208 on the monitoring assembly 70 are connected to the corresponding coupling elements 140 on the sealing assembly 60 to make the fluid connections. This places the first pressure monitor 254*a* of the monitoring assembly 70 in fluid communication via the bore monitoring port (142, 152) of the sealing assembly 60 with bore envelope (BE) of the subsea wellhead 10 below the plug assembly 120. Additionally, the second pressure monitor 254*b* of the monitoring assembly 70 is placed in fluid communication via the second port (144, 154) of the sealing assembly 60 with the annulus envelope (AE) between the annular seals 160, 170, which may be exposed to leakage in the annulus between the casing hanger 30 and the wellhead housing 20.

Once installed, the monitoring system 50 can provide pressure information to the operators in a number of ways. For example, the monitoring system 50 can include subsea gauges to be read during fly-by of an ROV. Alternatively, data storage available on the structure of the monitoring assembly 70 can be accessed by an ROV.

The monitoring assembly 70 can transmit pressure information using various telemetry and communication techniques. For example, the monitoring assembly 70 can store information locally in data storage and can transmit the information acoustically to a vessel when available. In another example, information can be stored in data storage on the monitoring assembly 70 and can be transmitted acoustically to a buoy. The transmitted information can be available for readings at a rate set by the operator and can be transmitted via satellite back to the operator's offices.

The monitoring system 50 can be used in a number of implementations. In a first implementation, the monitoring system 50 can be used for pressure testing an abandoned wellhead 10. In this case, the monitoring system 50 seals the abandoned wellhead 10 and pressure tests the well to make sure the well remains static as part of a monitoring or a plug and abandonment operation.

In a second implementation, the monitoring system 50 can be used for subsea wellhead monitoring on top of a casing hanger 30 in the subsea wellhead 10. In this instance, the sealing assembly 60 can lock into the completion's casing hanger, and the monitoring assembly 70 mounted on top of the wellhead 10 can lock to the sealing assembly 60. Once installed, the monitoring system 50 can monitor the pressure of the lower completion.

The monitoring system 50 can be run in open water with the sealing assembly 60 and the monitoring assembly 70 together, and the monitoring system 50 can be set hydraulically through a traditional hot stab connection. Alternatively, the sealing assembly 60 of the monitoring system 50 can be run through the BOP and can be set mechanically, followed by the monitoring assembly 70 being installed once the BOP is removed.

Overall, the monitoring system 50 can be designed to meet industry standards and requirements, such as API 6A/17D (Monogramed Wellhead and Tree Equipment). The monitoring system 50 can monitor legacy wells that are not producing, but the monitoring system 50 could be used for re-entry on lateral re-drills into new formations. The monitoring system 50 can modify the barrier requirements for reentry into such wells. The monitoring system 50 can also be used on production wells, should there be a delay in delivering subsea tress for deployment. As noted, some production trees are locked on wellheads and cannot be removed. The monitoring system 50 can lock into the top of the Tress Connector (like an XT running tool) to monitor the wellbore ensuring it remains static.

For example, the monitoring system 50 can act as a third barrier inside the subsea wellhead 10. As noted, three (3) barriers are required in the Gulf of Mexico when temporarily abandoning a well. Historically, the three barriers are provided using multiple levels of cement plugs ascending from the well shoe to the top of the wellhead (+/−30 ft below mudline). Installing the monitoring system 50 could reduce the total cost to re-enter the well.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A system for plugging and monitoring a subsea wellhead in a subsea environment, the subsea wellhead having a bore with a landing and a lock profile therein, the system comprising:

a hanger assembly configured to install on the landing and configured to engage the lock profile, the hanger assembly having an annular hanger seal configured to seal in the bore;

a plug assembly supported in the hanger assembly and having an annular plug seal, the annular plug seal configured to seal in the landing, the plug assembly at least defining first and second ports, the first port configured to communicate with a bore envelope of the subsea wellhead below the annular plug seal sealed in the landing, the second port configured to communicate with an annulus envelope between the annular plug seal sealed in the landing and the annular hanger seal sealed in the bore; and a monitoring assembly at least having first and second pressure monitors, the first pressure monitor configured to communicate with the first port and configured to measure a first pressure measurement related to the bore envelope, the second pressure monitor configured to communicate with the second port and configured to measure a second pressure measurement related to the annulus envelope.

2. The system of claim 1, wherein the hanger assembly comprises:

a hanger having a landing shoulder and the annular hanger seal, the landing shoulder configured to install on the landing;

a locking sleeve installed in the hanger; and a locking ring wedged between the hanger and the locking sleeve and configured to engage the lock profile.

3. The system of claim 2, wherein the locking sleeve comprises a retention ring configured to expand into a retention slot defined in a bowl of the hanger.

4. The system of claim 2, comprising a temporary retainer temporarily retaining the locking sleeve installed in the hanger.

5. The system of claim 2, wherein the plug assembly comprises:

a plug portion supported in the hanger, the plug portion having the annular plug seal disposed about a circumference of the plug portion; and a cap portion supported in the hanger above the plug portion and having a third annular seal, the third annular seal configured to seal the plug assembly in the locking sleeve.

6. The system of claim 5, comprising at least one seal element disposed between a connection of the plug portion to the cap portion and configured to seal therebetween.

7. The system of claim 5, wherein the landing shoulder comprises a landing ring biased against the hanger, the landing ring configured to engage the landing; and wherein the annular hanger seal comprises at least one seal element disposed on the hanger assembly between the landing ring and a surface of the hanger assembly, the at least one seal element being energized radially outward in response to bias of the landing ring toward the surface of the hanger assembly.

8. The system of claim 7, wherein the plug assembly comprises at least one seal element disposed between the plug assembly and the landing ring and configured to seal therebetween.

9. The system of claim 1, wherein:

the hanger assembly and the plug assembly define first and second chambers sealed therebetween, the first and second chambers defining sealed volumes complementary to one another, whereby an increase in the sealed volume of one of the first and second chambers produces a decrease in the sealed volume of the other of the first and second chamber; and the monitoring assembly comprises first and second hydraulic connections and first and second control valves, the first hydraulic connection being controlled by the first control valve and being configured to communicate with the first chamber, the second hydraulic connection being controlled by the second control valve and being configured to communicate with the second chamber.

10. The system of claim 9, wherein the monitoring assembly comprises a third hydraulic connection and a third control valve, the third hydraulic connection being controlled by the third control valve and being configured to communicate with the subsea wellhead.

11. The system of claim 1, wherein the hanger assembly comprises a landing ring biased on the hanger assembly and configured to engage the landing; and wherein the annular hanger seal comprises at least one seal element disposed on the hanger assembly between the landing ring and a surface of the hanger assembly, the at least one seal element being energized radially outward in response to bias of the landing ring toward the surface of the hanger assembly.

12. The system of claim 11, comprising at least one seal element disposed between the plug assembly and the landing ring of the hanger assembly and configured to seal therebetween.

13. The system of claim 1, wherein the annular plug seal comprises at least one seal element disposed about a circumference of the plug assembly, the at least one seal element having an elastomeric seal member.

14. The system of claim 1, wherein the annular plug seal is configured to insert past a shoulder of the landing in the subsea wellhead and is configured to expand outward to seal with a surface of the landing; and wherein the annular hanger seal is configured to insert past the locking profile in the subsea wellhead and is configured to expand outward to seal with the bore of the subsea wellhead.

15. The system of claim 1, wherein the plug assembly and the monitoring assembly comprise:

a first hydraulic connection configured to connect the first port and the first pressure monitor; and a second hydraulic connection configured to connect between the second port and the second pressure monitor.

16. The system of claim 1, wherein the first pressure monitor comprises a first pressure gauge configured to communicate with the bore envelope; and wherein the second pressure monitor comprises a second pressure gauge configured to communicate with the annulus envelope.

17. The system of claim 16, wherein the monitoring assembly comprises a third pressure gauge configured to communicate with the subsea environment and configured to measure a third pressure measurement related to hydrostatic pressure of the subsea environment.

18. The system of claim 1, wherein the monitoring assembly comprises an interface in electronic communication with the first and second pressure monitors, the first and second pressure measurements being readable via the interface.

19. The system of claim 18, wherein the interface comprises one or more of:

one or more electronic meters being configured to display the first and second pressure measurements;

memory configured to store the first and second pressure measurements and having a data link being electronically readable; and a telemetry system being configured to telemeter the first and second pressure measurements.

20. The system of claim 1, wherein the annular hanger seal comprises at least one seal element disposed about a circumference of the hanger assembly, the at least one seal element having an elastomeric seal member.

21. The system of claim 1, wherein the annular plug seal comprises at least one seal element disposed about a circumference of the plug assembly, the at least one seal element having a metal seal member.

22. The system of claim 21, wherein the metal seal member comprises a metal C-seal configured to provide a pressure-energized seal between the plug assembly and the landing, the metal C-seal having a first side, a second side, an inner dimension, and an outer dimension, the first side being convex, the second side defining an internal cavity, the internal cavity disposed toward the bore envelope, the inner dimension being free to engage an external surface of the plug assembly, the outer dimension being free to engage an internal surface in the landing, each of the inner and outer dimensions respectively engaging with a sealing force increasing with an increase in fluid pressure in the bore envelope acting in the internal cavity.

23. The system of claim 1, wherein the annular hanger seal comprises at least one seal element disposed about a circumference of the hanger assembly, the at least one seal element having a metal seal member.

24. The system of claim 23, wherein the metal seal member comprises a metal C-seal configured to provide a pressure-energized seal between the hanger assembly and the bore, the metal C-seal having a first side, a second side, an inner dimension, and an outer dimension, the first side being convex, the second side defining an internal cavity, the internal cavity disposed toward the annulus envelope, the inner dimension being free to engage an external surface of the hanger assembly, the outer dimension being free to engage an internal surface in the bore, each of the inner and outer dimensions respectively engaging with a sealing force increasing with an increase in fluid pressure in the annulus envelope acting in the cavity.

25. A method used with a subsea wellhead, the subsea wellhead having a bore with a landing and a lock profile therein, the method comprising:

passing a plug assembly, supported on a hanger assembly, past the landing in the bore of the subsea wellhead;

installing the hanger assembly on the landing in the bore of the subsea wellhead;

engaging the hanger assembly in the lock profile of the bore in the subsea wellhead;

sealing a first annular seal on the hanger assembly against the bore of the subsea wellhead;

sealing a second annular seal on the plug assembly in the landing;

hydraulically connecting a first pressure monitor of a monitoring assembly in fluid communication via a first port of the plug assembly with a bore envelope of the subsea wellhead below the plug assembly; and hydraulically connecting a second pressure monitor of the monitoring assembly in fluid communication via a second port of the plug assembly with an annulus envelope between the plug assembly and the subsea wellhead.

* * * * *